US005816718A

United States Patent [19]

Poole

[11] Patent Number: 5,816,718

[45] Date of Patent: Oct. 6, 1998

[54] HAND-HELD LABEL PRINTER APPLICATOR

[75] Inventor: David L. Poole, Libertyville, Ill.

[73] Assignee: Zebra Technologies Corporation, Vernon Hills, Ill.

[21] Appl. No.: 897,742

[22] Filed: Jul. 21, 1997

[51] Int. Cl.[6] ..... B41J 3/39

[52] U.S. Cl. ..... 400/88; 400/613; 101/288

[58] Field of Search ..... 101/288, 327, 101/328; 400/88, 613, 613.1; 347/171; 156/248, 249, 384, 385, 386, 387

[56] References Cited

U.S. PATENT DOCUMENTS

| | | | |
|---|---|---|---|
| Re. 30,697 | 8/1981 | Hamisch, Jr. | 156/384 |
| Re. 33,425 | 11/1990 | Nihei | 358/472 |
| 3,656,169 | 4/1972 | Kashio | 346/1 |
| 3,767,020 | 10/1973 | Rowe | 197/1 R |
| 3,902,952 | 9/1975 | Penaluna et al. | 156/384 |
| 4,109,777 | 8/1978 | Ottenstein et al. | 400/124 |
| 4,211,012 | 7/1980 | Alles et al. | 33/18 R |
| 4,407,692 | 10/1983 | Torbeck | 156/350 |
| 4,440,592 | 4/1984 | Sato et al. | 156/384 |
| 4,450,035 | 5/1984 | Hamisch, Jr. et al. | 156/384 |
| 4,483,733 | 11/1984 | Sato et al. | 156/541 |
| 4,497,682 | 2/1985 | Hamisch, Jr. | 156/384 |
| 4,523,235 | 6/1985 | Rajchman | 358/256 |
| 4,611,246 | 9/1986 | Nihei | 358/256 |
| 4,663,982 | 5/1987 | Nihira | 74/574 |
| 4,750,049 | 6/1988 | Murakami et al. | 358/296 |
| 4,862,281 | 8/1989 | Sato et al. | 358/400 |
| 4,901,164 | 2/1990 | Kurosawa | 358/473 |
| 4,904,330 | 2/1990 | Vanderpool et al. | 101/288 |
| 4,915,027 | 4/1990 | Ishibashi et al. | 101/486 |
| 4,933,867 | 6/1990 | Ishigaki | 364/519 |
| 4,947,262 | 8/1990 | Yajima et al. | 358/296 |
| 4,949,283 | 8/1990 | Yamauchi et al. | 364/519 |
| 4,956,045 | 9/1990 | Goodwin et al. | 156/384 |
| 4,980,009 | 12/1990 | Goodwin et al. | 156/249 |
| 5,002,410 | 3/1991 | Yajima | 400/88 |
| 5,013,388 | 5/1991 | Goodwin et al. | 156/384 |
| 5,015,324 | 5/1991 | Goodwin et al. | 156/384 |
| 5,018,026 | 5/1991 | Takada | 358/473 |
| 5,024,541 | 6/1991 | Tsukada et al. | 400/88 |
| 5,028,934 | 7/1991 | Kasai et al. | 346/76 |
| 5,052,832 | 10/1991 | Akiyama et al. | 400/120 |
| 5,079,639 | 1/1992 | Mochinaga | 358/473 |
| 5,110,225 | 5/1992 | Uchiyama | 400/29 |
| 5,112,149 | 5/1992 | Suenaga | 400/88 |
| 5,240,334 | 8/1993 | Epstein et al. | 400/88 |
| 5,263,994 | 11/1993 | Ueda | 400/157.3 |
| 5,308,173 | 5/1994 | Amano et al. | 400/88 |
| 5,322,380 | 6/1994 | Crocker | 400/124 |
| 5,516,219 | 5/1996 | Leonard et al. | 400/613 |
| 5,593,236 | 1/1997 | Bobry | 400/88 |
| 5,600,360 | 2/1997 | Lerner et al. | 347/171 |

FOREIGN PATENT DOCUMENTS

| | | |
|---|---|---|
| 2592337 | 7/1987 | France . |
| 2625706 | 7/1989 | France . |
| 2230671 | 10/1975 | Germany . |
| 2430411 | 1/1976 | Germany . |
| 2436164 | 11/1978 | Germany . |
| 2434626 | 12/1978 | Germany . |
| 2724855 | 5/1982 | Germany . |
| 3135776 | 7/1982 | Germany . |
| 3214760 | 9/1984 | Germany . |
| 3314041 | 9/1986 | Germany . |
| 3542715 | 6/1987 | Germany . |
| 3627494 | 2/1988 | Germany . |

(List continued on next page.)

*Primary Examiner*—Christopher A. Benett
*Attorney, Agent, or Firm*—Trexler, Bushnell, Giangiorgi & Blackstone, Ltd.

[57] ABSTRACT

A thermal hand-held printer applicator is disclosed preferably having a roller for gripping the work, a governor for limiting the speed of the roller and thereby the speed of motion of the printer applicator over the work, a tachometer for measuring the roller speed, a print head for printing an image on one of a thermally sensitive web of self adhesive labels, drive means for advancing the web and ejecting one label onto the work, and smoothing means for applying the label to the work.

16 Claims, 10 Drawing Sheets

FOREIGN PATENT DOCUMENTS

| | | |
|---|---|---|
| 4009137 | 9/1990 | Germany . |
| 3319115 | 6/1991 | Germany . |
| 59-114078 | 6/1984 | Japan . |
| 59-145166 | 8/1984 | Japan . |
| 60-240470 | 11/1985 | Japan . |
| 60-240472 | 11/1985 | Japan . |
| 61-64469 | 4/1986 | Japan . |
| 61-258756 | 11/1986 | Japan . |
| 61-280957 | 12/1986 | Japan . |
| 61-286172 | 12/1986 | Japan . |
| 63-51160 | 3/1988 | Japan . |
| 63-89362 | 4/1988 | Japan . |
| 63-107570 | 5/1988 | Japan . |
| 63-317368 | 12/1988 | Japan . |
| 1-190468 | 7/1989 | Japan . |
| 1-257072 | 10/1989 | Japan . |
| 645850 | 10/1984 | Switzerland . |
| 2078616 | 1/1982 | United Kingdom . |

HAND-HELD LABEL PRINTER APPLICATOR

BACKGROUND

This invention relates to label printers and applicators, and more particularly concerns a hand-held printer applicator which is user driven and can function to print a label and apply the printed label to an object in a single pass.

Hand held printers, and copiers are well known in the prior art. These use a linear array of electrically driven impact pins, ink jets, or thermal transfer heaters to form rows of dots directly on the work and transverse to the direction of scan under control of a computer. Typically, as taught by Kashio, U.S. Pat. No. 3,656,169, and Rowe, U.S. Pat. No. 3,767,020, relative motion between the device and the work is sensed by a roller coupled to an encoder which actuates the computer and printing mechanism to produce successive rows of dots which are evenly spaced independent of the speed of motion of the scan. Individual dots are selectively printed under the control of a computer to form characters or images.

Hand-held printers of the prior art are not well suited to the printing of bar codes. As they print directly on the object, they allow for the possibility that the user will print the bar code on a colored surface which provides insufficient contrast, or overprint text or other images, resulting in an unreadable symbol. These concerns are addressed by printing and applying a blank label of known contrast.

Hand-held labelers are also well known in the prior art. Some use impact of fully formed character drums as the label is advanced by a trigger mechanism. The printed label is then partially delaminated from a release strip by deflection around an acute angle and held thereby, so as to extend from the device with an adhesive surface exposed for application to the work. A brake mechanism is used to stop additional labels from being pulled out of the device as the exposed label is applied.

Other hand labelers better suited to bar coding use thermal printing mechanisms to mark the label as it is pulled through the mechanism by a motor at a constant speed. Such devices may also be manually actuated by the return of a trigger spring governed by a dashpot as disclosed in U.S. Pat. No. 4,497,682 to Hamisch, Jr. This latter approach is difficult to adapt to labels greater than an one inch in length because the energy to advance the entire label must be stored in the trigger spring in a single actuation.

In prior art labelers, the printing operation is complete before application begins. The label may be stored in a cassette for later application, or partially delaminated from the carrier with one end held thereby for immediate application, or it may be completely delaminated and held in a system of rollers from and with which it may be freely applied.

OBJECTS AND SUMMARY OF THE DISCLOSURE

The object of this invention is to print and label the work in a single operation.

A further object is to drive the printing motion from the applying motion so as to avoid the need for a motor to advance the label.

A further object is to govern the speed of application and therefore the speed of print to a range optimal for thermal printing, and more specifically of bar codes.

Other objects and advantages of the invention will become apparent upon reading the following detailed description and upon reference to the drawings. Throughout the description, like referenced numerals refer to like parts.

Briefly, and in accordance with the foregoing objects, the present invention comprises a hand-held user-driven printer applicator including a housing means having a base and a cover, drive means mounted in the housing means, the drive means including a roller for gripping an object to be labeled and advancing a media web of labels through the housing means, and printer means for forming a printed image on the media label. Preferably, the invention further comprises delaminating means and smoothing means for applying the label onto an object, and governor means for limiting the speed of the drive means to ensure optimal quality of the printed image formed on the label.

BRIEF DESCRIPTION OF THE DRAWINGS

The above features and objects of the present invention will become more apparent with reference to the following description taken in conjunction with the accompanying drawings, wherein like reference numerals denote like elements and in which.

DESCRIPTION OF THE PREFERRED EMBODIMENT

Figure 1:
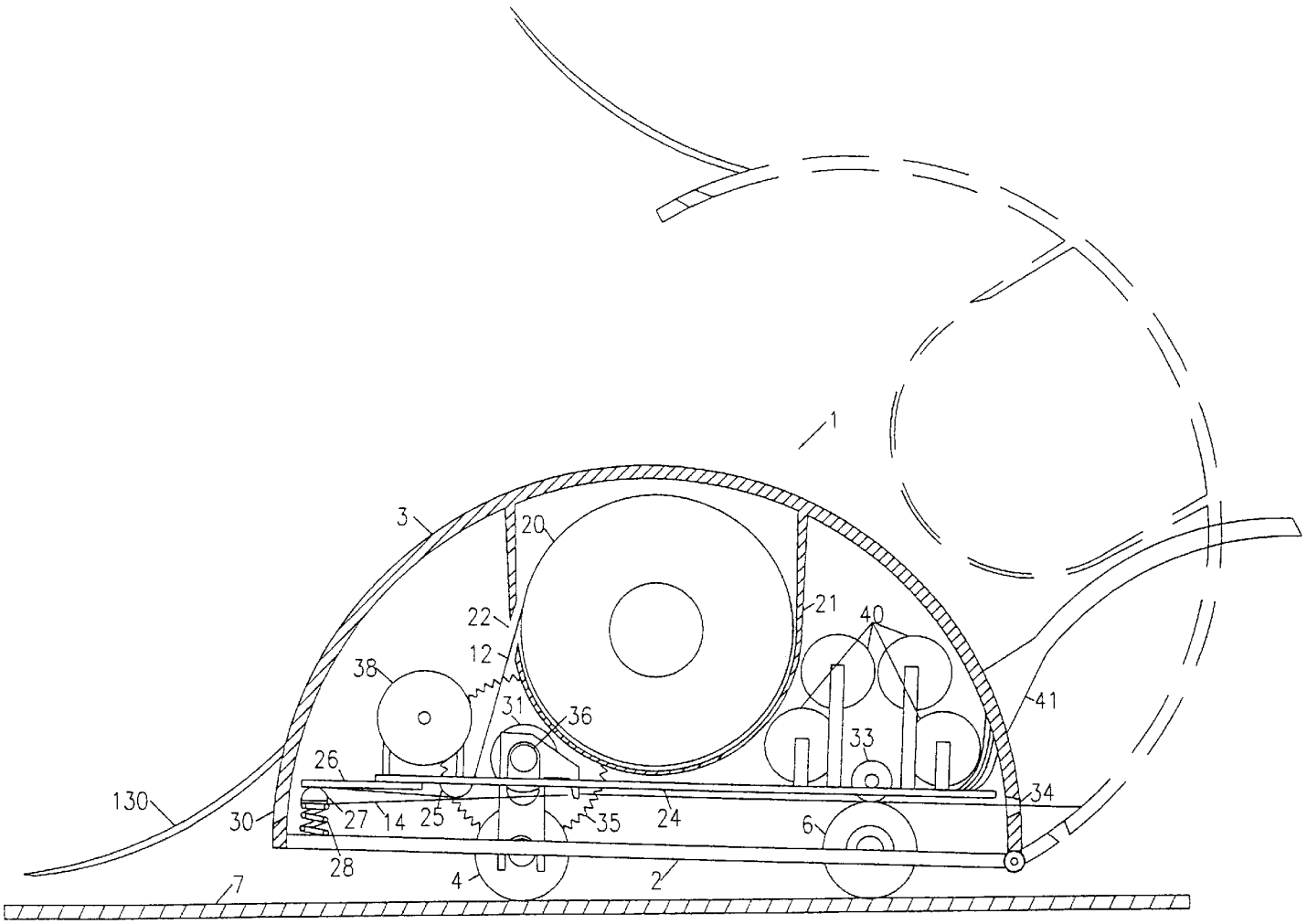
FIG. 1 is a sectional side-view of the present invention illustrating, in phantom lines, a cover member in an open position.

While the invention may be susceptible to embodiment in different forms, there are shown in the drawings and herein will be described in detail, specific embodiments with the understanding that the present disclosure is to be considered an exemplification of the principles of the invention and that it is not intended to limit the invention to that as is illustrated and described herein.

Figure 2:
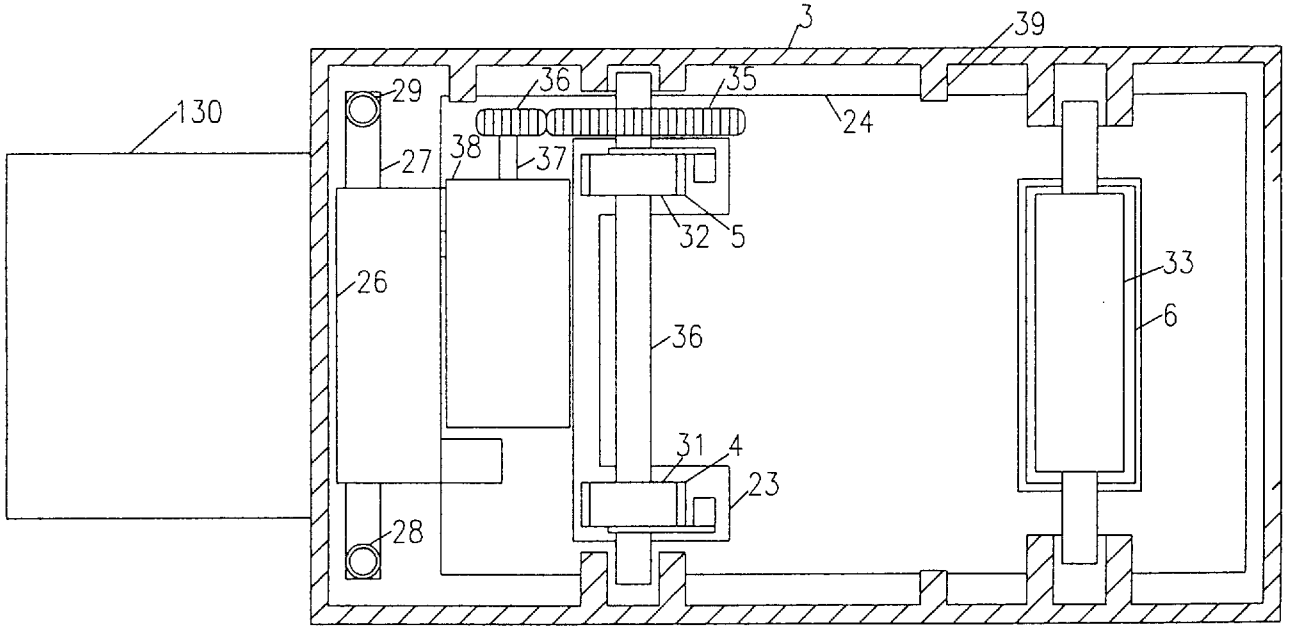
FIG. 2 is a sectional plan-view of the printer applicator illustrated in FIG. 1.

With reference to FIG. 1, the printer applicator 1 is built on base 2 having cover 3 pivotally attached so it can be raised for media loading. Base 2 and cover 3 are formed of injection molded plastic with internal molded features which support the internal parts further described below. With reference to FIG. 1 and FIG. 2, first and second drive rollers 4 and 5 and rear roller 6 having gripping rubber surfaces are rotatably attached to base 2 and protrude through it. As shown in FIG. 1, printer applicator 1 is resting on work 7 ready to begin labeling.

Figure 4:
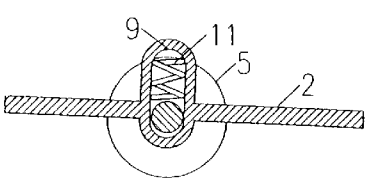
FIGS. 3 and 4 are sectional isolated views of drive roller member of the present invention.
Figure 3:
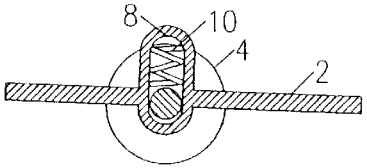

With reference to FIG. 3 and FIG. 4, first and second drive rollers 4 and 5 are retained in elongated guide slots 8 and 9 in base 2 and biased away from it by springs 10 and 11 respectively. Springs 10 and 11 have sufficient total force to overcome the weight of the printer applicator and extend drive rollers 4 and 5 away from the frame when the printer applicator is at rest on the work.

Figure 5:
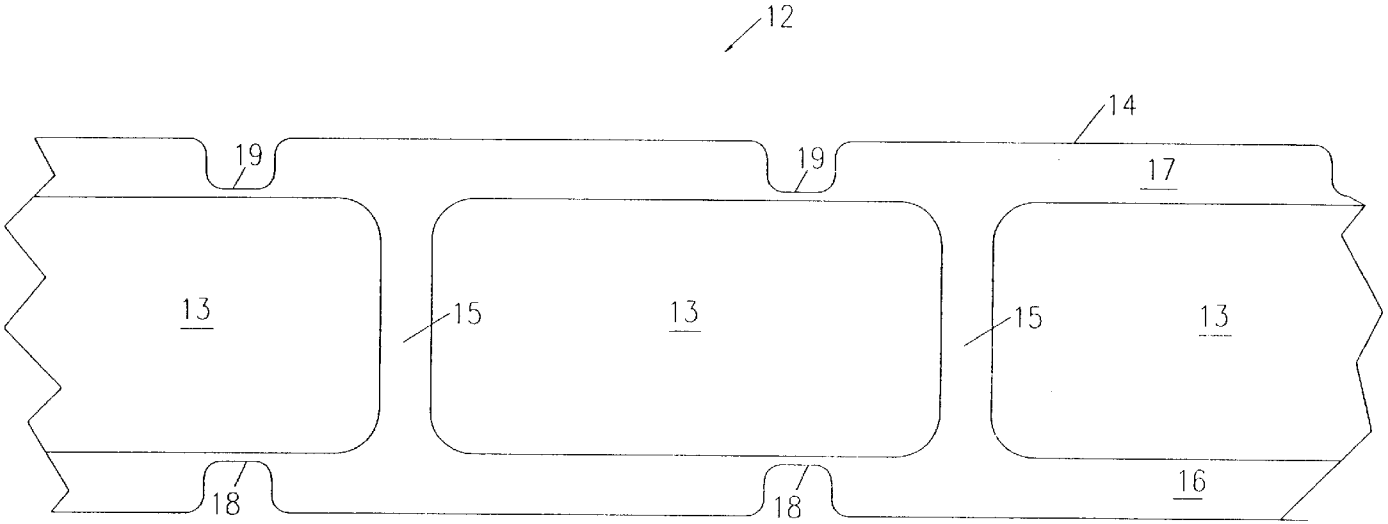
FIG. 5 illustrates a portion of a media web used in the printer applicator of the present invention.

With reference to FIG. 5, media web 12 consists of a plurality of die cut self adhesive labels 13 releasably attached to a release liner 14. Release liner 14 is exposed at gaps 15 between labels and along margins 16 and 17. Release liner 14 is further die cut with a plurality of notches 18 and 19 in margins 16 and 17 respectively.

Returning to FIG. 1 and FIG. 2, media web 12 is supplied from supply roll 20 held in pocket 21 of cover 3, routed through first slot 22 in pocket 21, through second slot 23 in circuit board 24, around guide 25, and pressed against print head 26 by pressure pad 27 acted upon by head pressure springs 28 and 29.

Release liner 14 makes a 180 degree bend around pressure pad 27, to cause delamination of any label passing that point and its ejection through label exit slot 30 in cover 3. In the preferred embodiment, printer 1 further includes smoothing blade 130 to promote proper securement of the label to the object. Release liner 14 then passes between drive wheels 4 and 5 and pinch rollers 31 and 32 respectively. From there, release liner 14 passes between rear roller 6 and friction roller 33 then out through backing exit slot 34 in cover 3.

With continued reference to FIG. 1 and FIG. 2, in the preferred embodiment first and second pinch rollers 31 and 32 and first gear 35 are affixed to common axle 36 which is in turn rotatably retained in cover 3. First gear 35 meshes with second gear 36 attached to shaft 37 of braking motor 38. Braking motor 38 is physically attached to and electrically connected to printed circuit board 24. Circuit board 24 is attached to cover 3 by a plurality of integrally molded supports 39. Circuit board 24 mounts and electrically interconnects braking motor 38, print head 26, batteries 40 and cable 41 and the electronic components represented in FIG. 6.

Figure 6:
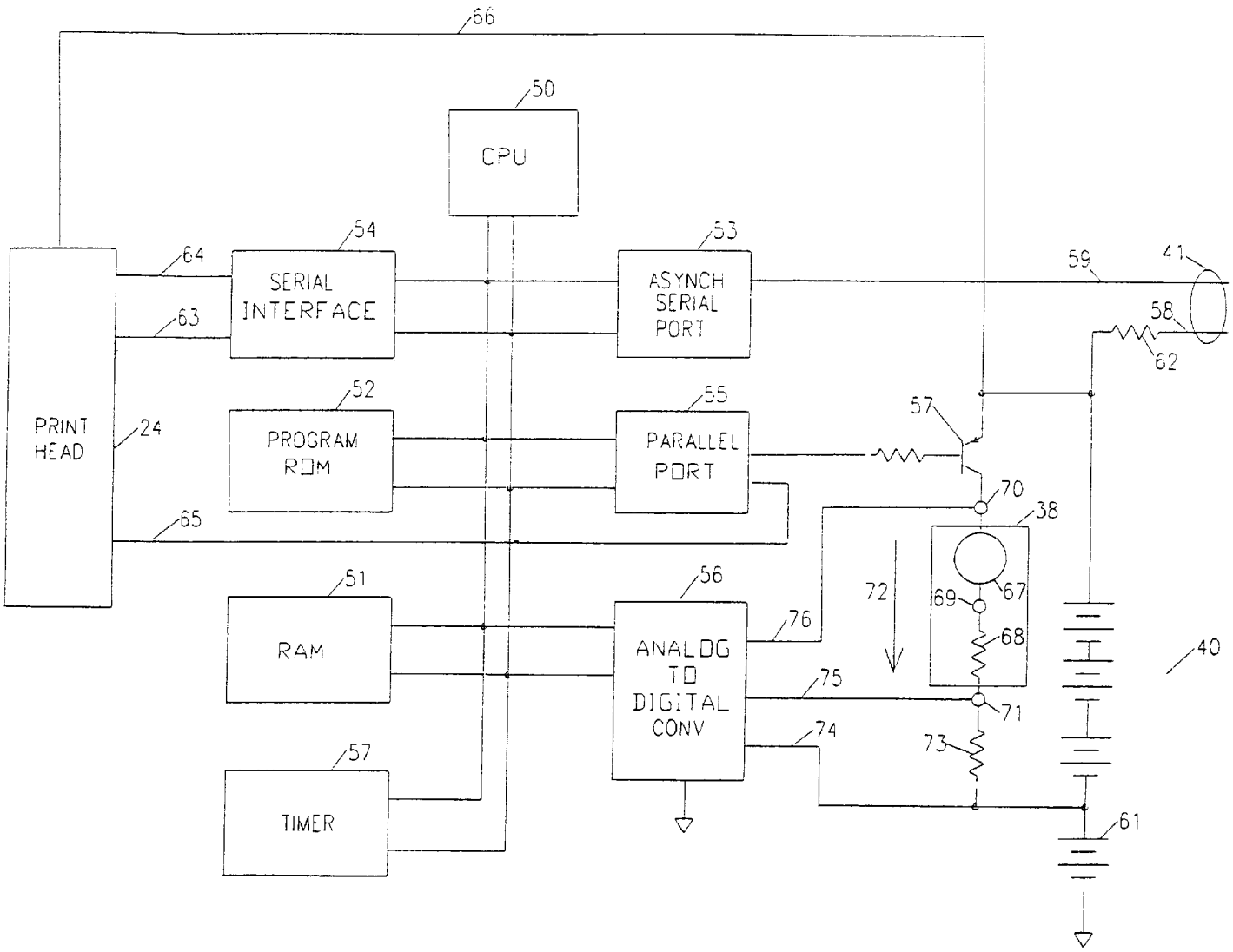
FIG. 6 is a schematic representing a circuit board included in the present invention.

With reference to the schematic of FIG. 6 representing circuit board 24, microprocessor 50 is a single chip embedded controller such as the Hitachi H8 series. Although the H8 includes RAM memory 51, program ROM memory 52, asynchronous serial port 53, synchronous serial interface 54, parallel port 55, analog to digital converter 56, and timer 57, it will be readily understood by those skilled in the art that other microprocessors can be used with the addition of equivalent functions as separate integrated circuits, and any such system is intended to lie within the scope of the claims.

Cable 41 carries DC power from a wall mounted power supply (not shown) via line 58 and asynchronous serial data from the users PC via line 59. Battery 40 consists of a three NICAD cells in series with a single cell 61, all of which are continuously trickle charged from the wall mounted supply through resistor 62. The connection to the single cell 61 is to keep positive voltages at the inputs of analog to digital converter 56.

Before printing, CPU 50 accepts asynchrouous serial data representative of the bitmap image to be printed from asynchronous serial port 53, and stores it as a bitmap image in RAM 51. During printing, CPU 50 periodically transfers rows of dots from RAM 51 to print head 26 via serial data line 63 and clock line 64, which periodicity will be further described below. CPU 50 then asserts strobe 65 which enables the selected heaters of print head 26 for a period as will be further described below. During strobe 65, print head 24 draws power from battery 40 via line 66.

With continued reference to FIG. 6, braking motor 38 is represented by an ideal motor 67 in series with an armature resistance 68. Rotation of braking motor shaft 37 generates an electromotive force EMF in ideal motor 67 which appears as a voltage between internal node 69 and motor terminal 70. This voltage is directly proportional to the shaft speed of braking motor 38. It cannot be measured directly in the presence of an armature current because it appears in series with the voltage drop in the armature resistance 68. However, if the armature current is independently measured and its value multiplied by the armature resistance 68 and subtracted from the measured voltage between motor terminals 70 and 71, the resulting EMF can be determined and thereby the motor shaft speed and the linear velocity of the printer applicator over the work.

The braking current in the motor, as shown by the numbered arrow 72 passes through metering resistor 73, producing a voltage drop which is determined in microprocessor 50 by subtracting the voltage read at line 74 from that read at line 75 by analog to digital converter 56. The braking current is then calculated by dividing the voltage drop by a constant equal to the ohmic value of metering resistor 73.

The motor terminal voltage is similarly calculated by subtracting the voltage read at line 75 from that read at line 76. The armature voltage drop is then calculated by multiplying the braking current by a constant equal to the ohmic value of armature resistance 68. The voltage across ideal motor 67 is then calculated by subtracting the armature drop from the terminal voltage. The velocity of the printer applicator over the work is then calculated by multiplying the voltage thus calculated across ideal motor 67 by a constant representing the combination of the motor constant, the ratio of gears 35 and 36, and the circumferences of drive rollers 4 and 5 and pinch rollers 31 and 32.

Microprocessor 50 controls via port 55 a switching transistor 57 which switches voltage from batteries 40 motor 38 in such a polarity so as to cause motor 38 to exert a braking force on the printer applicator. Transistor 57 is switched on and off very rapidly with a controlled duty cycle, the prior art technique known as pulse width modulation. Microprocessor 50 thus controls the average voltage to motor 38 and thereby the degree of braking force applied to the printer applicator.

The user sends serial data representing a bitmap of the image to be printed as serial data over cable 41. The serial data includes a byte count followed by the bitmap data in row column order, but any prior art data format may be used and is considered to fall within the scope of the appended claims. Microprocessor 50 stores the bitmap in RAM memory 51 as the data is received.

Figure 7:
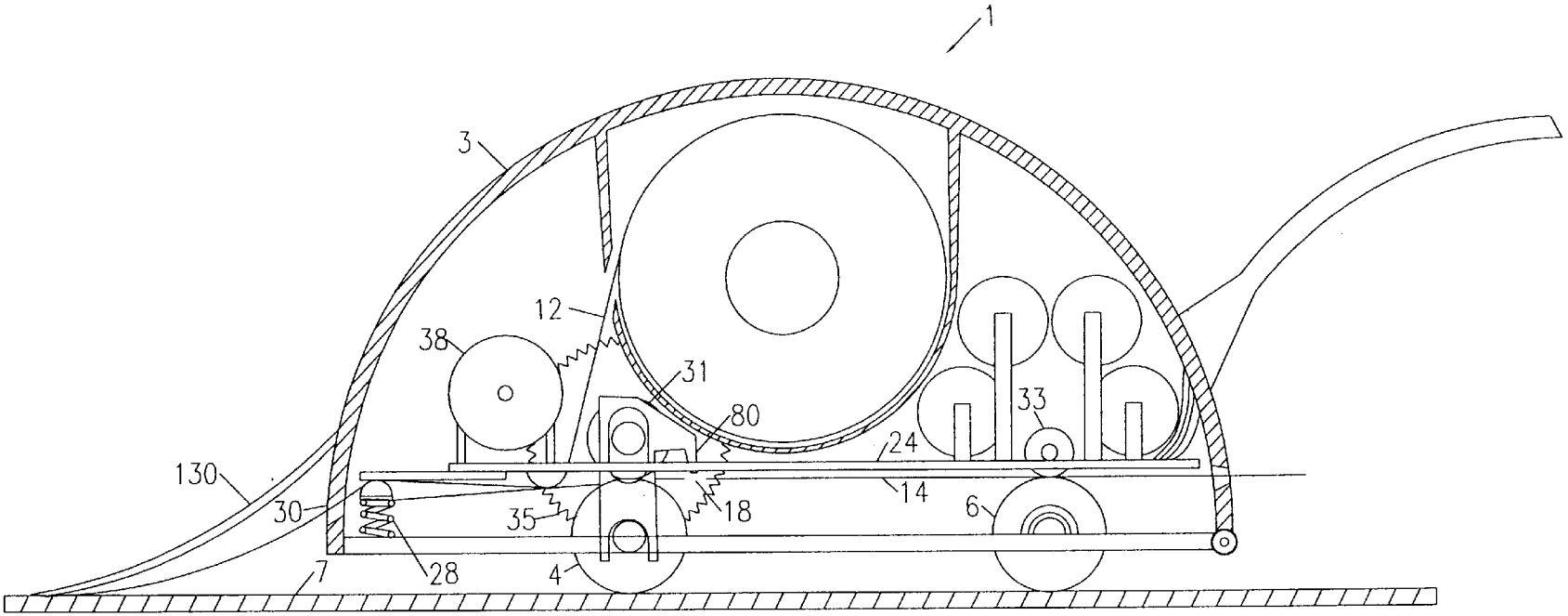
FIGS. 7 and 8 are similar to FIGS. 1 and 2, respectively.
Figure 8:
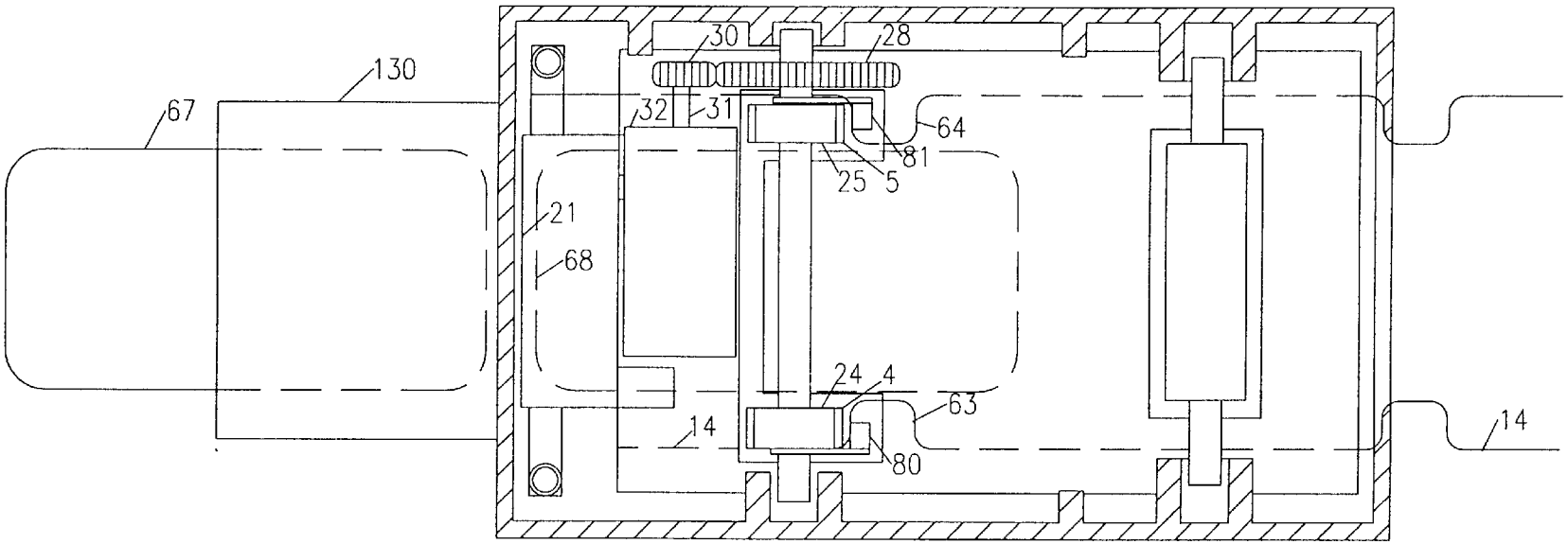

When the complete image has been sent, the user presses down on printer applicator 1. With further reference to FIG. 7 and FIG. 8, this action engages release liner 14 between drive rollers 4 and 5 and pinch rollers 31 and 32 respectively and pushes pawls 80 and 81 out of notches 18 and 19 in release liner 14. The user then rolls the printer applicator 1 along work 7 in a direction away from label exit slot 30. As he does so, feed rollers 4 and 5 grip work 7 and engage pinch rollers 31 and 32, rotating first gear 35, second gear 36 and motor shaft 37 of motor 38. Media web 12 having been positioned as further described below, exposed margin of release liner 14 will be engaged by feed rollers 4 and 5 and pinch rollers 31 and 32, respectively, thereby pulling web 12 through the housing.

With reference to FIG. 8, notches 18 and 19 in release liner 14 are positioned so as to fall between drive rollers 4 and 5 and pinch rollers 31 and 32 respectively when printed label 82 has been ejected from the printer applicator. This stops the motion of the web even though the user may continue to drag the printer applicator over the work. To prepare the printer applicator for another label, the user lifts up on the printer applicator and pulls on spent release liner 14 so as to advance it until pawls 80 and 81 drop into notches 18 and 19. Pawls 80 and 81 stop the web at the point where the leading edge of the next label 83 is under print head 26 and ready for the next application.

Figure 9A:
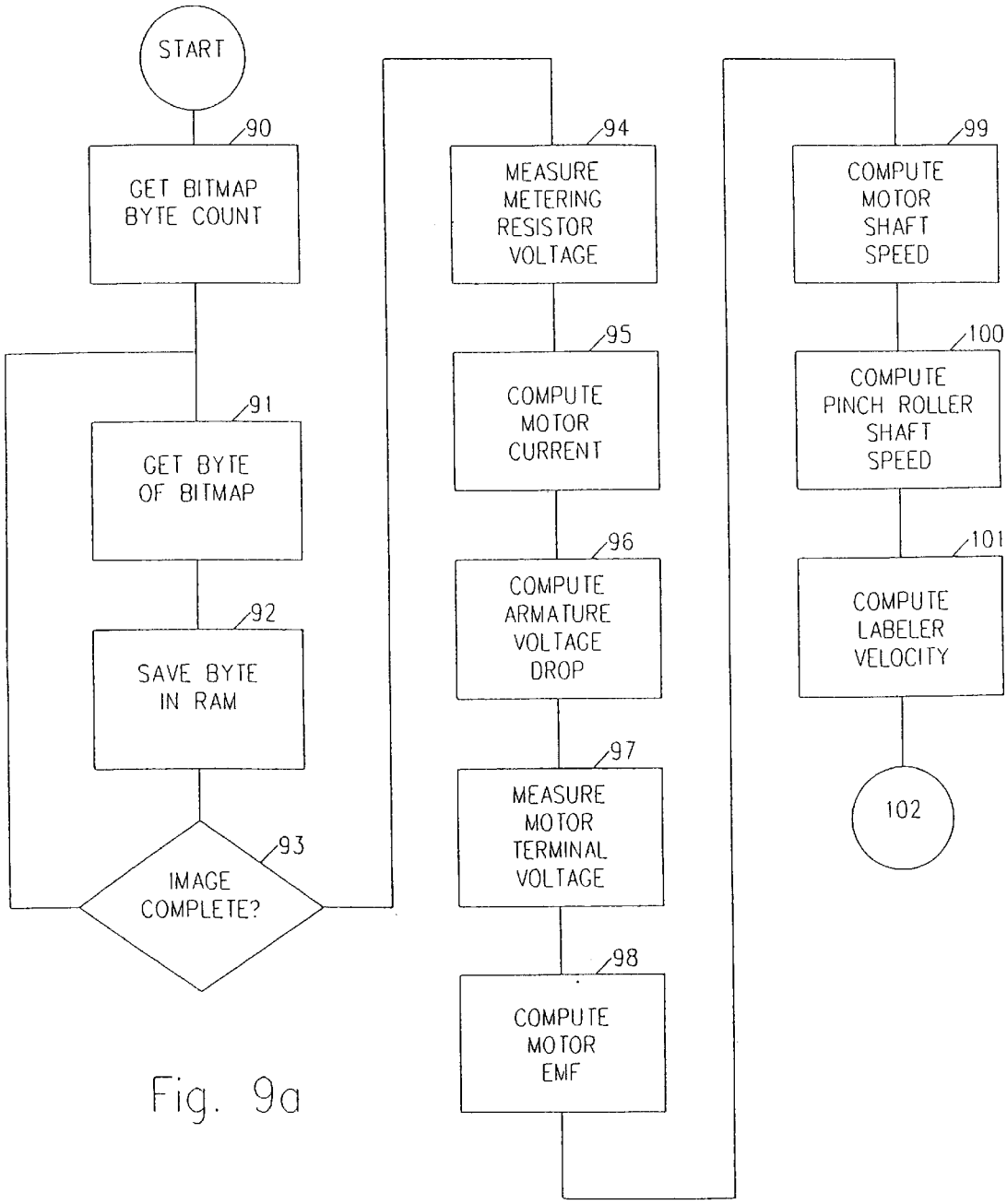
FIGS. 9*a* to 9*c* are flowcharts illustrating the functions of a computer program carried out during operation of the present invention.

With reference to the schematic of FIG. 6 and the flowchart of FIG. 9*a,* representing the functions of the program in program ROM 52, blocks 90, 91, 92, and 93 represent the loading of the complete bitmap into RAM 51 as previously described. Block 94 reads the voltage at lines 74 and 75 and subtracts to obtain the voltage across metering resistor 73. Block 95 divides this voltage by a constant equal to the resistance of resistor 73 to obtain the motor current 72. Block 96 multiplies current 72 by a constant equal to the armature resistance 68 of motor 38 to estimate the voltage drop across the armature resistance 68.

Block 97 reads the voltages at line 75 and 76 and subtracts to obtain the terminal voltage across motor 38. Block 98 subtracts the armature drop previously calculated from the terminal voltage to obtain the EMF across ideal motor 67. Block 99 multiplies the motor EMF thus calculated by a coefficient representing the shaft velocity to EMF coefficient of ideal motor 67. Block 100 multiplies the shaft velocity thus calculated by a constant equal to the ratio of gears 35 and 36 to determine the shaft velocity of drive rollers 4 and 5. Block 101 multiplies by a constant equal to the circumference of pinch rollers 31 and 32 to determine their tangential velocity and thereby that of drive rollers 4 and 5 which equals the printer applicator velocity.

Figure 9B:
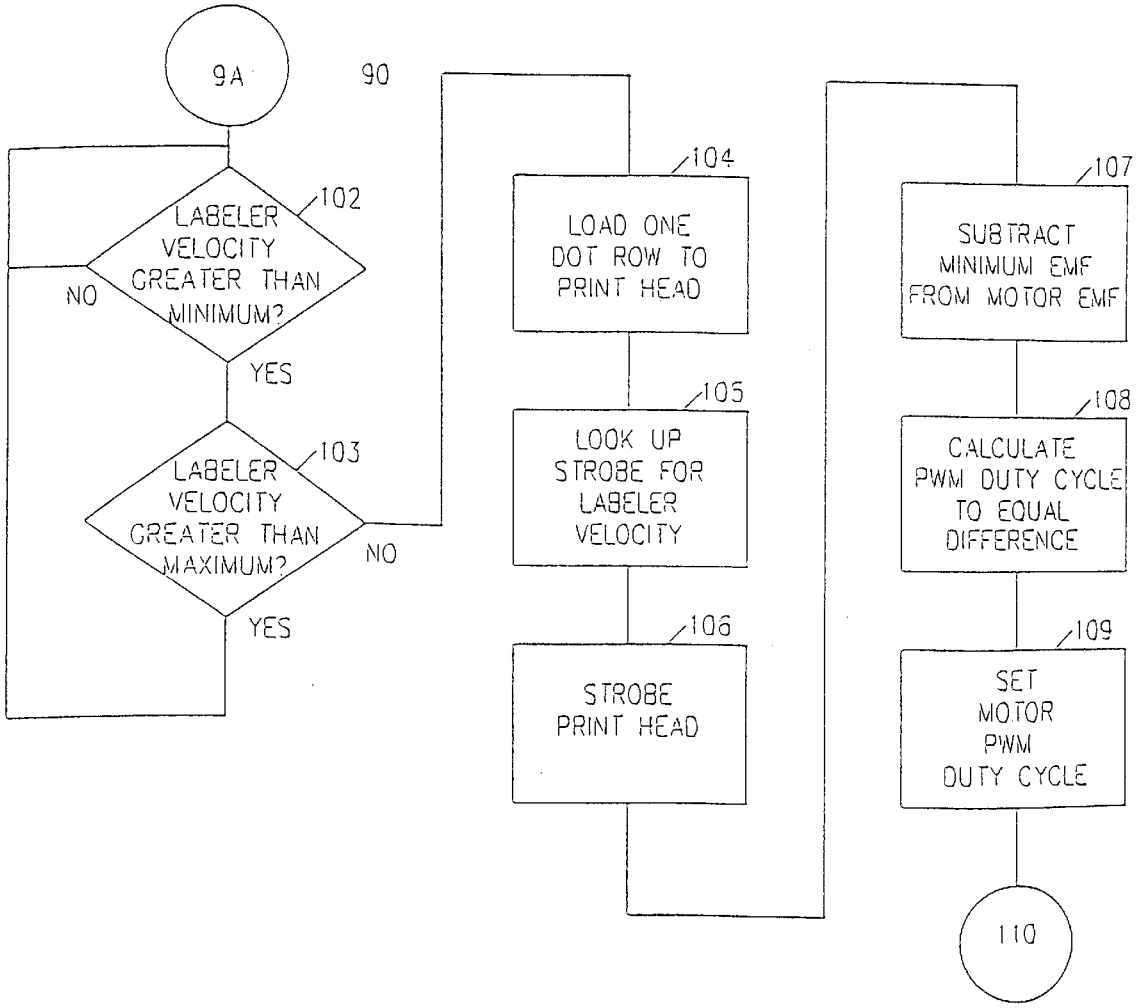
Figure 9C:
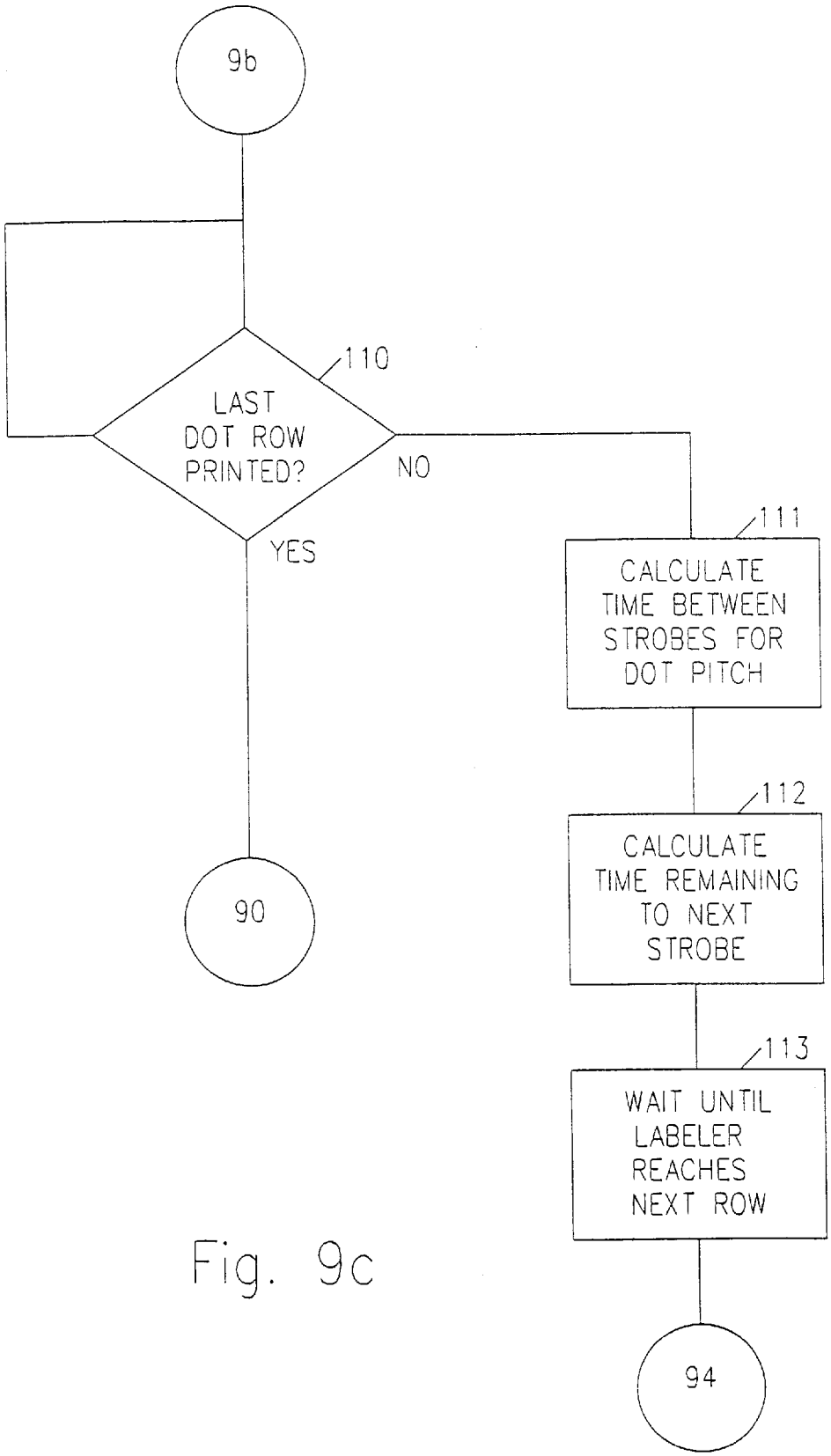

With reference to FIG. 9*b,* Block 102 compares the printer applicator velocity previously computed against a constant representing the minimum printer applicator velocity for acceptable thermal printing. If the printer applicator is not above the minimum velocity, block 102 loops to wait for the user to accelerate the printer applicator to the minimum velocity. Once minimum velocity has been reached, block 103 determines that a maximum velocity is not exceeded. If that velocity is exceeded, execution loops to block 102 to wait for the user to obtain a speed between the minimum and maximum velocities. Once this condition has been met, block 104 loads one row of dots from bitmap into printhead 24 using serial clock and data in the prior art manner.

The lack of braking force below the minimum velocity and the progressive application of braking force above the minimum velocity as will be described below provide the user with a kinesthetic indication when the velocity for proper printing is reached and make it progressively difficult to exceed the maximum velocity. Nonetheless, variations in the forcefulness with which users pull on the printer applicator result in variations in its speed of motion. The effect of these variations in speed on the print quality are thereby minimized.

Block 105 uses the printer applicator velocity previously calculated to index a table of known ideal strobe lengths versus printer applicator velocity which is stored in program ROM 52. The strobe length in the table improves the consistency of optical density between the minimum and maximum speeds. Block 106 times this strobe to the print head.

Block 107 subtracts a stored constant equal to the motor EMF at the minimum velocity (the reverse calculation of blocks 99, 100, and 101 at the minimum velocity) from the motor EMF previously computed at Block 98. Block 108 computes the duty cycle of battery voltage which averages to that difference. Block 109 sets that PWM value as the duty cycle to braking transistor 57. The resulting braking force opposes any excess force applied by the user to limit the velocity of the printer applicator above the minimum velocity for optimal thermal printing.

Block 110 determines if the last dot row of the bitmap has been printed. If more remains to print, block 111 calculates the time between strobes during which the printer applicator advances by the amount of the dot pitch by dividing the dot pitch by the printer applicator velocity. Block 112 calculates the remaining time to the next strobe by subtracting the time since the last strobe. Block 113 waits for this remaining time before looping back to block 94 to repeat the cycle. If the last row of the bitmap has been printed execution proceeds to block 90 to await a new bitmap image.

Alternate Embodiments

While the preferred embodiment teaches optimization of print quality by both governing the speed of the printer applicator to within a range and measuring that speed and firing dots accordingly, images of reduced print quality can be printed within the governed speed range by firing the dots periodically at a rate appropriate to the approximate speed.

It will be equally apparent to one skilled in the art that the speed measurement of the preferred embodiment as performed by electrical measurements at the terminals of motor 38 can equivalently be carried out by a rotary encoder. Speed measurement then becomes a matter of timing the logic pulses from the tachometer as is well known in the prior art, rather than by measuring an analog voltage as herein described.

It will also be apparent to one skilled in the art that the braking function of motor 38 can equivalently be performed by a mechanical governor of such form as is well known in the prior art and that such structures lie within the scope of the claims.

It should be noted that the use of motor 38 both as braking motor and tachometer provides a means of covering both functions at minimal cost, providing a significant cost and performance advantage to the preferred embodiment. Although the preferred embodiment performs these functions with an analog-to-digital converter and calculations in software, it should be obvious to one skilled in the art that equivalent amplifiers and multipliers can be used.

It should be noted that the simultaneous printing and application functions is at the heart of this printer applicator, and that the invention applies equally to thermal, thermal transfer, impact, and inkjet printing as are well known in the prior art.

It should also be noted that this invention can be similarly applied to a self adhesive web without the benefit of a release liner as is known in the prior art (see U.S. Pat. No. 5,560,293 to Boreali et.al).

Figure 10:
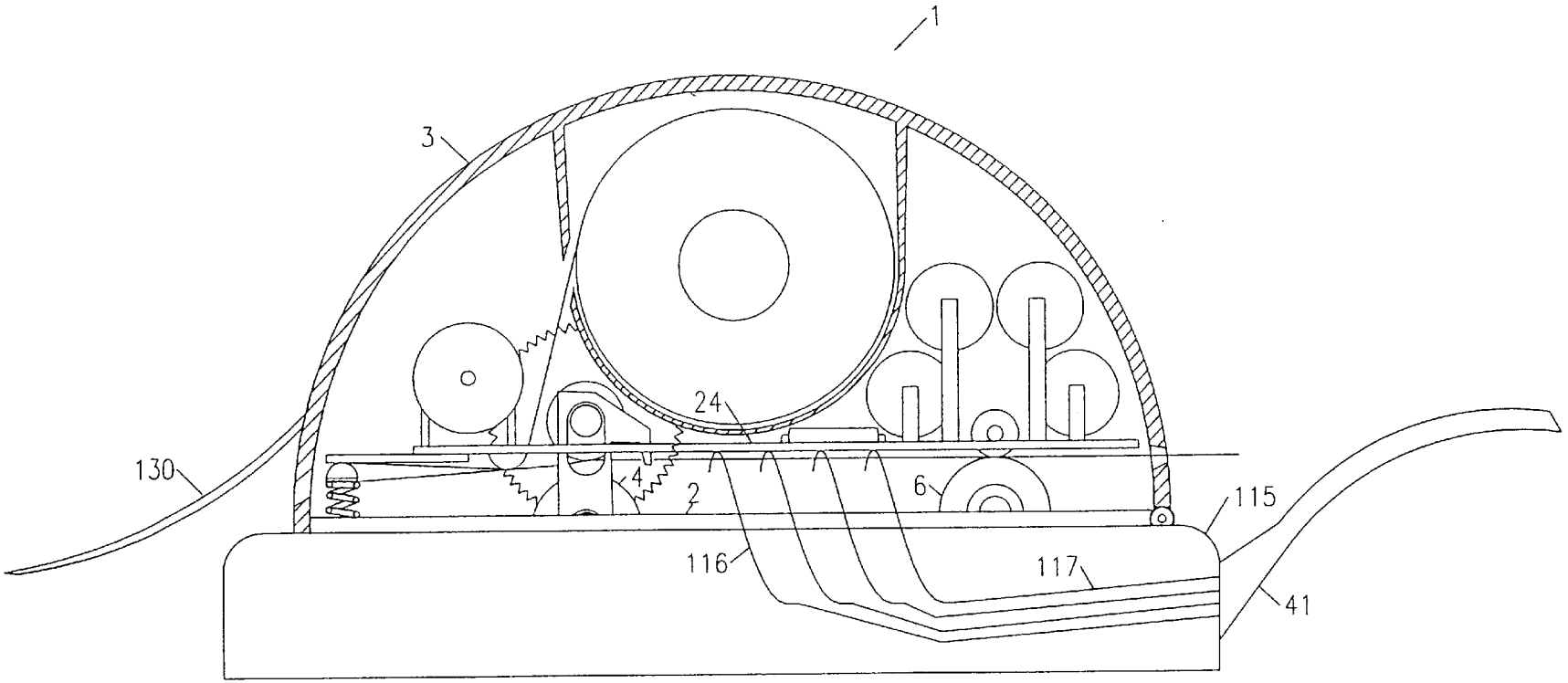
FIG. 10 is similar to FIGS. 1 and 7 illustrating an alternate embodiment of the printer applicator of the present invention in which a recharging and data reloading cradle is provided.

FIG. 10 shows a further alternate embodiment in which labeler 1 is provided with cradle 115, preferably formed of injection molded plastic and having internal cavities (not shown) adapted to nest with base 2 and rollers 4 and 6. Cord 41 is attached to cradle 115 in lieu of the attachment to the printer applicator itself as in the preferred embodiment. Cradle 115 is further provided with spring contacts 116 and wire connections 117 to cable 41. Spring contacts 116 are positioned to directly contact circuits on printed circuit board 24 in lieu of the direct connections of the preferred embodiment.

While particular embodiments have been shown and described in detail, it will be obvious to those skilled in the art that changes and modifications of the present invention, in its various aspects, may be made without departing from the invention in its broader aspects, some of which changes and modifications being matters of routine engineering or design and others being apparent only after study.

As such, the scope of the invention should not be limited by the particular embodiment and specific construction defined herein, but should be defined by the appended claims and equivalents thereof. Accordingly, the aim of the appended claims is to cover all such changes and modifications as fall within the true spirit and scope of the invention.

The invention is claimed as follows:

1. A hand-held, hand-propelled, label printer applicator comprising:

housing means including a base and a cover;

drive means mounted in the housing means;

a media web of labels also mounted in the housing; and printing means for forming a printed image on the media web;

said drive means including a roller means for gripping an object to be labeled and, simultaneously, advancing a media web of labels through the housing means.

2. A label printer applicator as recited in claim 1, further comprising delaminating means for applying a label formed from a portion of said media web onto said object.

3. A label printer applicator as recited in claim 2, wherein said delaminating means further includes smoothing means for promoting proper securement of the label to the object.

4. A label printer applicator as recited in claim 1, further comprising governor means for limiting the speed of said drive means and thereby ensuring optimal quality of the printed images formed by the printing means.

5. A label printer applicator as recited in claim 4, wherein said governor means further includes tachometer means.

6. A label printer applicator as recited in claim 4, wherein the governor means includes motor means for generating a braking force.

7. A label printer applicator as recited in claim 4, wherein the governor means includes a single motor means for generating a braking force, and for providing a tachometer means for measuring the speed of said roller.

8. A label printer applicator as recited in claim 6, wherein said motor means further comprising a DC motor.

9. A label printer applicator as recited in claim 5, wherein said tachometer means includes a DC motor, and measurement means for the back EMF of said motor.

10. A label printer applicator as recited in claim 4, wherein said governor means includes a DC motor for generating a braking force on said roller means, and for providing tachometer means responsive to the speed of said roller means.

11. A label printer applicator as recited in claim 1, wherein the printer applicator further comprises a rechargeable power supply and a recharging cradle.

12. A hand-held, hand-propelled, label printer applicator for printing and applying a label to an object simultaneousy in a single operation, said label printer applicator comprising:

a base and cover operatively associated with each other;

a supply roll of label media;

a drive system for advancing the label media as the label printer applicator is moved relative to an object to be labeled;

a delaminator for ejecting labels from the label printer applicator and onto the object to be labeled; and a printer for forming an image on a label at the same time that the label is applied to the object.

13. A label printer applicator as recited in claim 12, wherein a label smoother is also provided acting in cooperation with the delaminator to ensure that the labels are properly secured to the object.

14. A hand-held, hand-propelled, direct labeler for labeling an object in a single operation, said direct labeler comprising:

housing means including a base and a cover;

drive means mounted in the housing means;

printing means for forming a printed image on an object; and governor means for limiting the speed of said drive means and thereby ensuring optimal quality of the printed images formed by the printing means.

15. A direct labeler as recited in claim 14, wherein said governor means further includes tachometer means.

16. A direct labeler as recited in claim 14, wherein the governor means includes motor means for generating a braking force.

* * * * *

UNITED STATES PATENT AND TRADEMARK OFFICE

CERTIFICATE OF CORRECTION

PATENT NO. : 5,816,718

DATED : October 6, 1998

INVENTOR(S) : David 1. Poole

It is certified that error appears in the above-indentified patent and that said Letters Patent is hereby corrected as shown below:

Column 8, Line 13 "simultaneousy" should be -- simultaneously --

Signed and Sealed this

Eleventh Day of May, 1999

*Attest:*

Q. TODD DICKINSON

*Attesting Officer*

*Acting Commissioner of Patents and Trademarks*